US007221773B2

(12) United States Patent
Takahashi

(10) Patent No.: US 7,221,773 B2
(45) Date of Patent: May 22, 2007

(54) OVAL SPEAKER APPARATUS AND METHOD OF MANUFACTURING THE SAME

(75) Inventor: Osamu Takahashi, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 11/053,890

(22) Filed: Feb. 10, 2005

(65) Prior Publication Data

US 2005/0175205 A1 Aug. 11, 2005

(30) Foreign Application Priority Data

Feb. 10, 2004 (JP) ..... P2004-034267

(51) Int. Cl.
*H04R 25/00* (2006.01)

(52) U.S. Cl. ..... 381/430; 381/407

(58) Field of Classification Search ..... 381/396, 381/398, 400, 401, 403, 404, 407, 408–410, 381/423–424, 430, 431; 181/157, 167–173
See application file for complete search history.

(56) References Cited

U.S. PATENT DOCUMENTS

| | | | | |
|---|---|---|---|---|
| 3,935,400 | A * | 1/1976 | Koga | 381/430 |
| 4,376,233 | A * | 3/1983 | Kamon et al. | 381/409 |
| 6,404,896 | B1 * | 6/2002 | Yoo et al. | 381/401 |
| 6,594,372 | B2 * | 7/2003 | Nakaso | 381/396 |
| 6,597,798 | B1 * | 7/2003 | Nakazono et al. | 381/410 |

FOREIGN PATENT DOCUMENTS

JP 8-223687 A 8/1996

* cited by examiner

*Primary Examiner*—Suhan Ni
(74) *Attorney, Agent, or Firm*—Sughrue Mion PLLC

(57) ABSTRACT

An oval speaker apparatus includes a diaphragm whose outer peripheral shape in a plan view is oval or elliptical; an oval or elliptical voice coil for driving the diaphragm; an edge which is joined to an outer periphery of the diaphragm; and a frame to which an outer peripheral edge of the edge is fixed. Further, lead wire which is led out from the voice coil is wired so as to traverse the surface of the edge along the minor-axis direction of the diaphragm, and is provided with slack.

2 Claims, 5 Drawing Sheets

OVAL SPEAKER APPARATUS AND METHOD OF MANUFACTURING THE SAME

CROSS-REFERENCE TO RELATED APPLICATION

The invention claims priority to Japanese Patent Application No. JP 2004-034267 filed on Feb. 10, 2004. The disclosure of the prior application is incorporated herein by reference in its entirety.

BACKGROUND OF THE INVENTION

1. Field of the Invention

The present invention relates to an oval speaker apparatus employing a diaphragm and a voice coil whose outer peripheral shapes in a plan view are oval or elliptical, as well as a method of manufacturing the same.

2. Description of the Related Art

Generally, an electrodynamic speaker has a round diaphragm, a round voice coil for driving this diaphragm, an edge joined to an outer periphery of the diaphragm, a frame to which an outer peripheral edge of this edge is fixed, a magnetic circuit on the frame for housing the voice coil, and lead wires led out from the voice coil.

Further, a wiring structure is configured that the lead wires led out from the voice coil are wired in such a manner as to traverse the diaphragm and the edge in the radial direction, extend along surface of the diaphragm or the edge, and are led out from the outer peripheral edge of the edge.

In such a wiring structure of the lead wires, if a wiring is configured straightly over the surface of the diaphragm or the edge, abnormal noise such as buzzing is generated due to amplitude of the diaphragm and the edge during operation. In addition, bending load or tensile load comes to be repeatedly applied to the lead wires, possibly resulting in the disconnection of the lead wires. Accordingly, methods of manufacturing a speaker in which a wiring is configured by providing slack have been proposed (refer to JP-A-8-223687, for example).

Meanwhile, as one of electrodynamic speakers, attention has recently focused on an oval speaker apparatus employing a diaphragm whose outer peripheral shape in a plan view is oval or elliptical.

Since the outer peripheral shape of the diaphragm in a plan view is oval or elliptical, as compared with a general speaker apparatus using the round diaphragm, this oval speaker apparatus has advantages in that not only can it be easily mounted in such as a space where a width is narrow, but it is possible to obtain a wide area on the diaphragm by portions expanding in its major-axis direction, making it possible to improve the low-range reproduction. In addition, in a case where the diaphragm is a dome type diaphragm in which its center protrudes from its peripheral edge, as compared with a cone type in which its center is concaved to the inner recess, there is no containment of high-frequency components, and a radiation angle of sound is wide. Therefore, there are also advantages that the directionality is weak, and degree of freedom of mounting in an apparatus or the like improves.

Namely, the oval speaker apparatus is very useful as a high-performance micro speaker which is mounted in a portable telephone or portable audio equipment, and studies have been made devotedly.

In such an oval speaker apparatus as well, to prevent amplitude of the edge from resulting in generating the abnormal noise such as buzzing and the disconnection of the lead wires, it is also effective to wire the lead wires by providing slack, as described above.

SUMMARY OF THE INVENTION

However, in the case of the oval speaker apparatus, a weight balance of a vibration system becomes lost due to a weight of the lead wires, as will be described later, and a rolling phenomenon occurs. Consequently, there arises the problem that distortion occurs in a reproduced sound.

For example, FIG. 1 shows an example of a wiring structure of lead wires in an oval speaker apparatus.

In a diaphragm 51 shown in FIG. 1 and whose outer peripheral shape in a plan view is oval, an edge 53 is joined to its outer periphery. Further, a voice coil 52 for driving the diaphragm 51 is fitted in a groove formed in an outer periphery of the diaphragm 51.

The voice coil 52 and lead wires 54 and 55 are led out from the voice coil 52 on a minor axis 56 of the oval, are wired along a major-axis direction of the oval over the edge 53, and are led out to an outer peripheral edge of the edge 53. Further, as bent portions 54*a* and 55*a* are formed midway in the wiring of these lead wires 54 and 55, slack is provided for allowing the amplitude of the edge 53.

With the above-described oval speaker apparatus, the disconnection of the lead wires 54 and 55 can be prevented by the slack using the bent portions 54*a* and 55*a*. However, since the edge 53 connected to the outer periphery of the diaphragm 51 is highly flexible and easily flexurally deformable in the major-axis direction where the width is long, if the lead wires 54 and 55 are wired along the major-axis direction, as described above, the weight balance of the vibration system becomes lost due to the weight of the lead wires 54 and 55, and the rolling phenomenon is likely to occur in the directions of arrows A. Consequently, there arises the problem that distortion occurs in the reproduced sound due to the rolling phenomenon.

As problems to be solved by the invention, it is possible to cite the problem that in an oval speaker apparatus employing a diaphragm and a voice coil whose outer peripheral shapes in a plan view are oval or elliptical, disconnection of lead wires is prevented, and occurrence of distortion in the reproduced sound due to rolling phenomenon is overcome.

According to an embodiment of the invention, there is provided an oval speaker apparatus including: a diaphragm whose outer peripheral shape in a plan view is one of oval and elliptical; a voice coil for driving the diaphragm, having one of an oval shape and an elliptical shape; an edge which is joined to an outer periphery of the diaphragm; and a frame to which an outer peripheral edge of the edge is fixed, wherein a lead wire which is led out from the voice coil is wired so as to traverse a surface of the edge along a minor-axis direction of the diaphragm, and are provided with slack.

According to an embodiment of the invention, there is provided a dome type diaphragm having one of an oval shape and an elliptical shape, including: a voice coil; a lead wire led out from the voice coil, wherein the lead wire is wired so as to traverse a surface of an edge along a minor-axis direction, and are provided with slack.

According to an embodiment of the invention, there is provided a voice coil having one of an oval shape and an elliptical shape, including: a lead wire led out from the voice coil, wherein the lead wide is wired so as to traverse a surface of an edge along a minor-axis direction of a diaphragm, and are provided with slack.

According to an embodiment of the invention, there is provided a method of manufacturing an oval speaker apparatus including a diaphragm whose outer peripheral shape in a plan view is one of oval and elliptical, a voice coil having one of an oval shape and an elliptical shape for driving the diaphragm, an edge joined to an outer periphery of the diaphragm and a frame to which an outer peripheral edge of the edge is fixed, including steps of: connecting an end of a lead wire to an end of a coil of the voice coil attached to the diaphragm; leading out the lead wire from the voice coil; and wiring the lead wire so as to traverse a surface of the edge along a minor-axis direction of the diaphragm providing with predetermined slack.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Referring now to drawings, a detailed description will be given of an embodiment of the oval speaker apparatus according to the invention.

Figure 1:
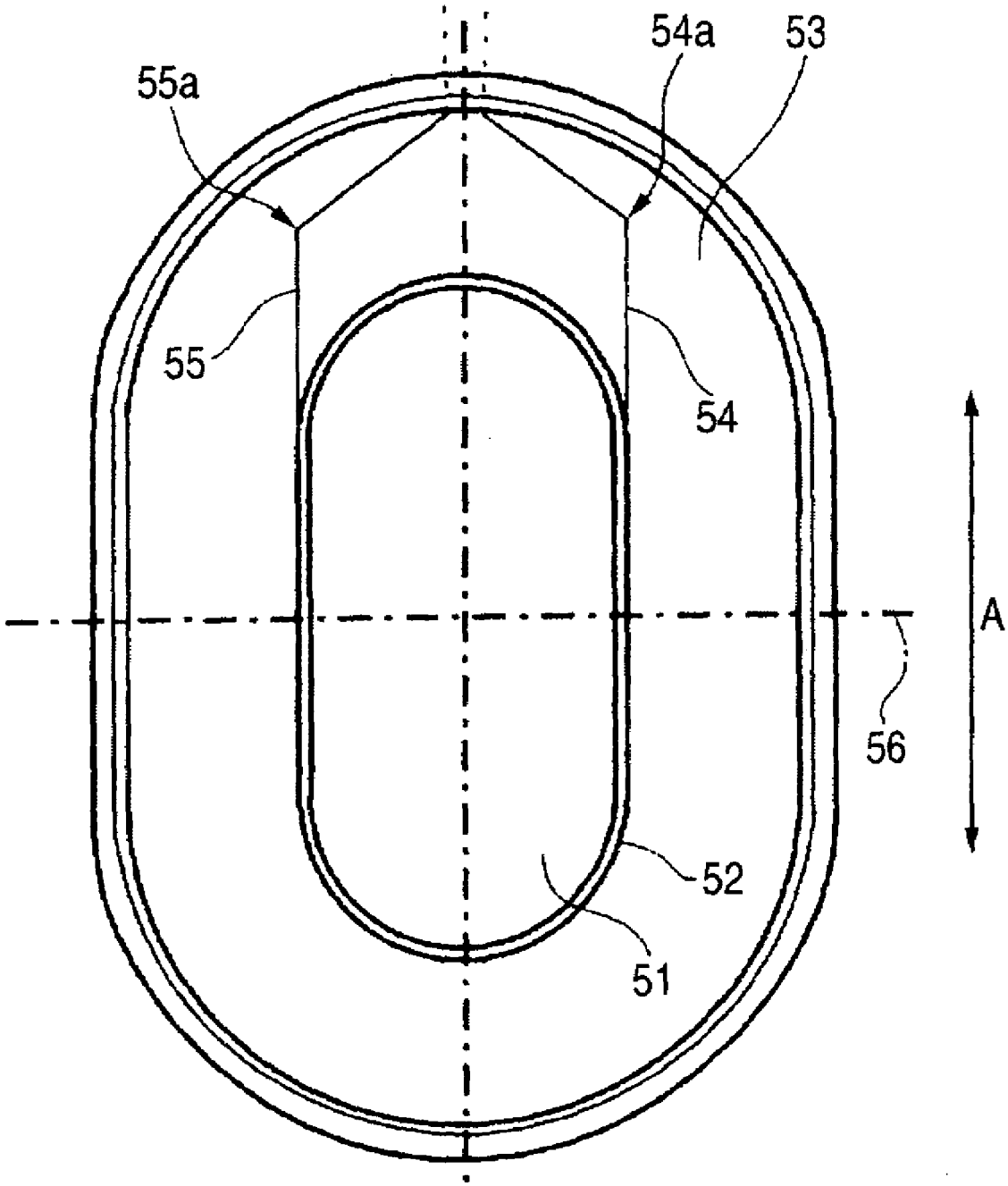
FIG. 1 is an explanatory diagram of an example of the wiring structure of lead wires in an oval speaker apparatus.
Figure 2:
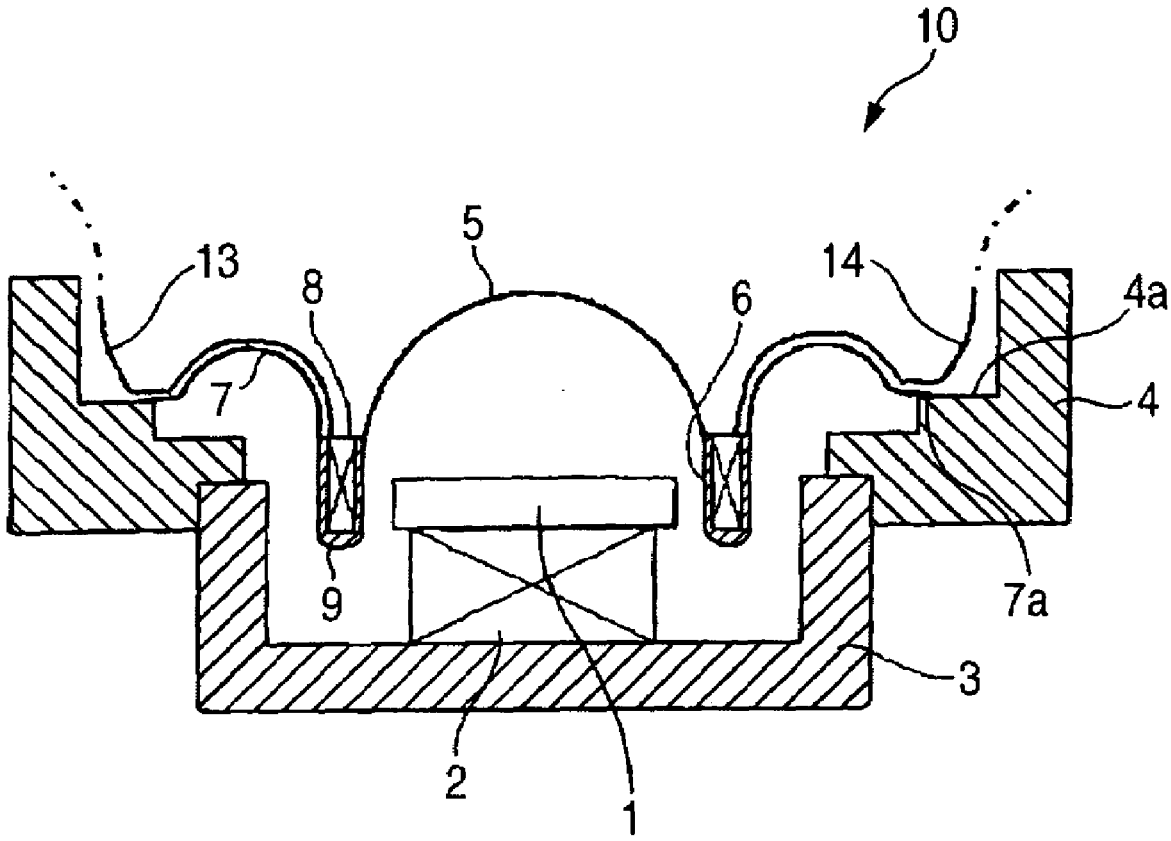
FIG. 2 is a vertical cross-sectional view of an oval speaker apparatus in accordance with an embodiment of the invention.
Figure 3:
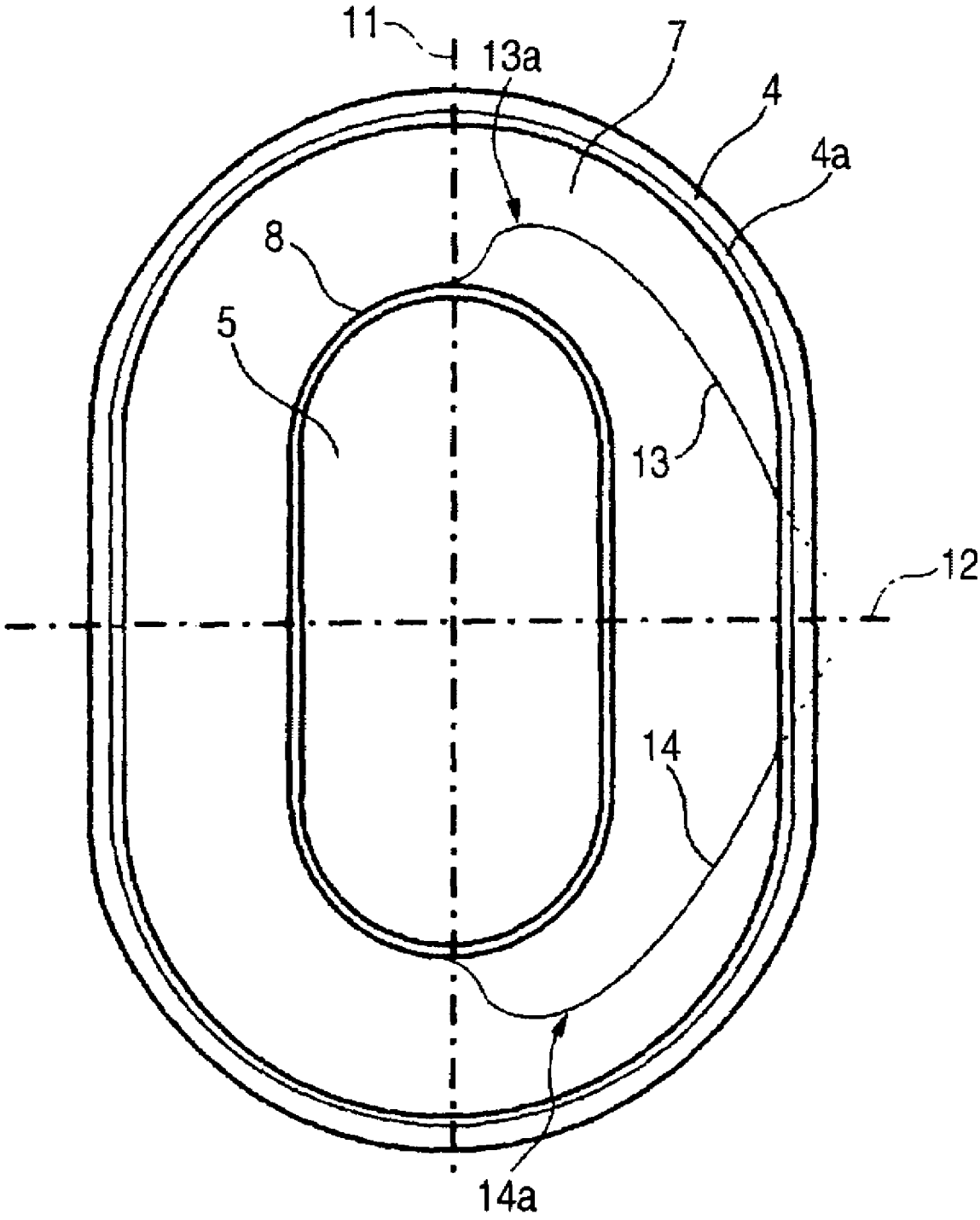
FIG. 3 is a plan view illustrating a wiring structure of lead wires in the oval speaker apparatus in accordance with the embodiment of the invention.
Figure 4:
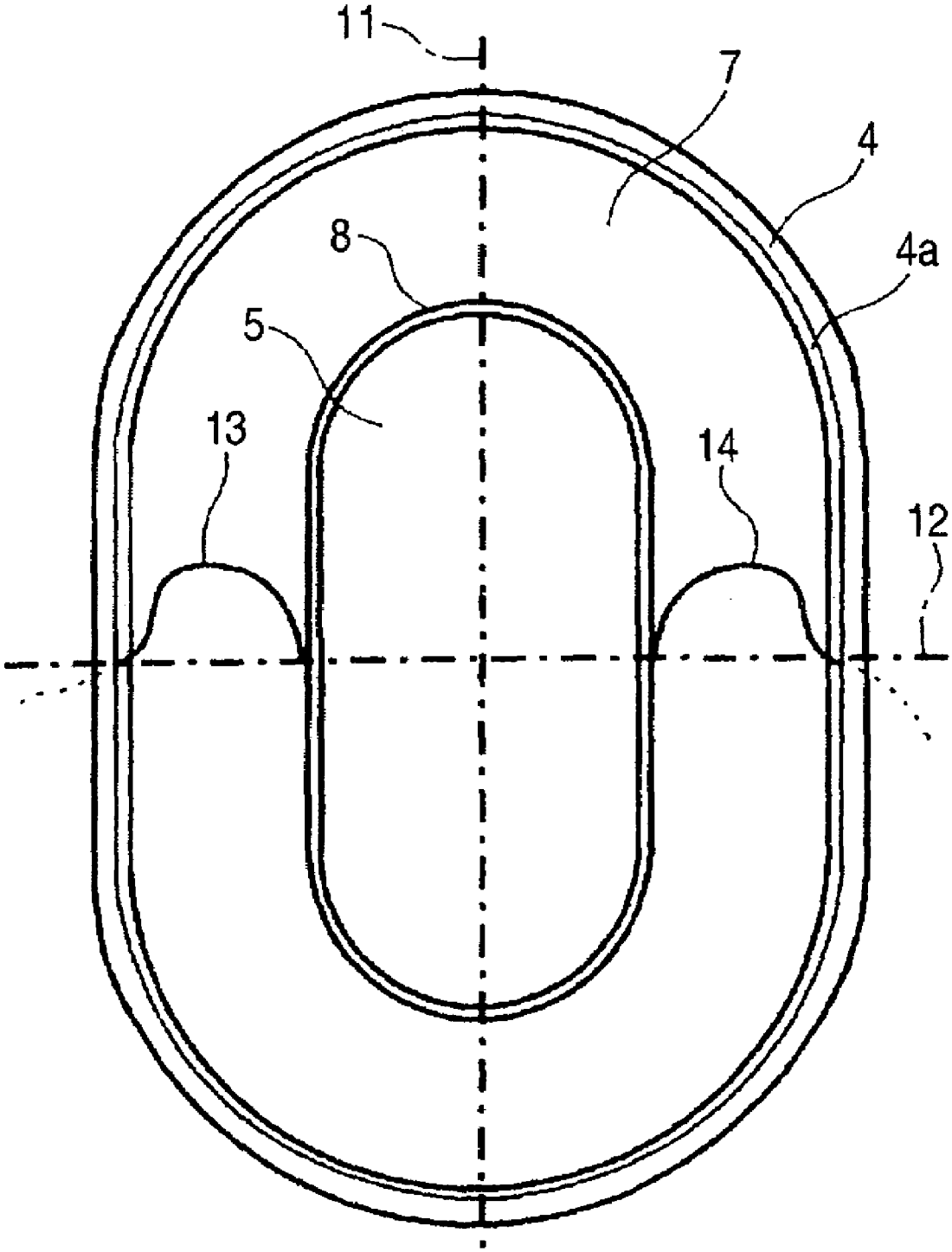
FIG. 4 is a plan view illustrating the wiring structure of the lead wires in a first modification of the oval speaker apparatus in accordance with the embodiment of the invention.
Figure 5:
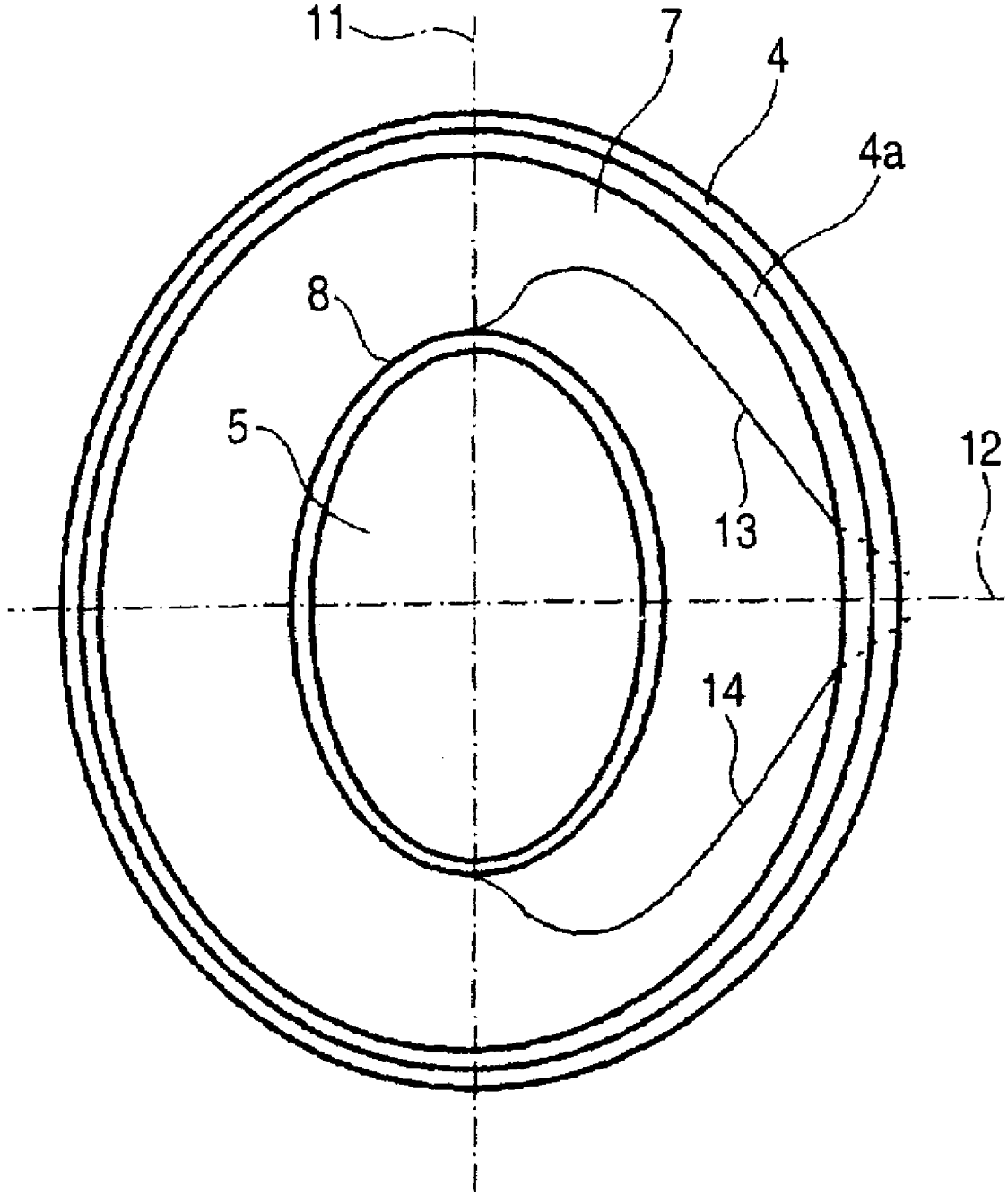
FIG. 5 is a plan view illustrating the wiring structure of the lead wires in a second modification of the oval speaker apparatus in accordance with the embodiment of the invention.

FIG. 2 is a vertical cross-sectional view of an oval speaker apparatus according to an embodiment of the invention; FIG. 3 is a plan view illustrating a wiring structure of lead wires in the oval speaker apparatus according to the embodiment of the invention; FIG. 4 is a plan view illustrating the wiring structure of the lead wires in a first modification; and FIG. 5 is a plan view illustrating the wiring structure of the lead wires in a second modification.

In an oval speaker apparatus 10 according to the embodiment of the invention, a magnetic circuit having an annular magnetic gap is formed by a disk-shaped pole plate 1, a magnet 2 and a yoke 3, as shown in a cross-sectional view of FIG. 2.

The magnetic gap is a gap at a portion where a side surface of the pole plate 1 and the yoke 3 oppose each other, and the magnetic gap is substantially uniform all around. Further, a frame 4 is integrally formed on the outer side of the yoke 3 for forming the magnetic circuit.

In addition, a dome type diaphragm 5 whose outer peripheral edge has a flat oval shape is disposed above the pole plate 1 of the magnetic circuit.

A recess portion 6 having a U-shaped cross section is provided annularly on an outer peripheral edge portion of the diaphragm 5, and an edge 7 is provided on an outer peripheral edge portion of this recess portion 6. Further, an edge attaching frame 7*a* having a horizontal surface is provided on an outer peripheral edge portion of the edge 7.

The diaphragm 5, the recess portion 6, the edge 7 and the edge attaching frame 7*a* are integrally formed by subjecting, for example, a single sheet of resin film or the like to heating and pressure molding.

The edge 7 elastically supports both the diaphragm 5 and the recess portion 6, and the edge attaching frame 7*a* is attached to an engaging portion 4*a* provided on the frame 4.

Inside the recess portion 6, a voice coil 8, which is formed by winding an electric wire around a voice coil bobbin (or without using the voice coil bobbin) having an elliptical cross section corresponding to the outer peripheral shape of the diaphragm 5, is bonded to the recess portion 6 by an adhesive 9. Accordingly, the voice coil 8, together with the recess portion 6, is disposed and floatingly supported in the magnetic gap of the magnetic circuit by the edge 7.

As shown in FIG. 3, a pair of lead wires 13 and 14 connected to both ends of the electric wire of the voice coil 8 are respectively led out at both ends of a major axis 11 of the voice coil 8 from the recess portion 6 to an obverse surface side of the speaker. The pair of lead wires 13 and 14 are then provided with predetermined slack 13*a* and 14*a* and are traversed over the edge 7 along the minor-axis direction of the diaphragm 5, so as to be led out to the outer peripheral edge of the edge 7.

It should be noted that in a process of manufacturing the oval speaker apparatus 10, when ends of the pair of lead wires 13 and 14 are connected to the voice coil 8, the lead wires 13 and 14 are connected such that the ends of the lead wires 13 and 14 are oriented in a tangential direction with respect to an outer periphery of winding of the voice coil 8.

As a result, leading out of the lead wires 13 and 14 from the voice coil 8 is configured to be in the tangential direction with respect to the voice coil 8 at the outer peripheral portion of the voice coil 8. Hence, connecting portions of the lead wires 13 and 14 do not configure bent portions which can cause such as a concentration of stress, and it is possible to improve durability with respect to tension or the like applied to the lead wires 13 and 14.

In the above-described oval speaker apparatus 10, since the respective lead wires 13 and 14 led out from the voice coil 8 are provided with the slack 13*a* and 14*a* at portions where they traverse the edge 7, it is possible to absorb the amplitude of the edge 7 by expansion and shrinkage of the slack 13*a* and 14*a*, thereby making it possible to prevent the disconnection of the lead wires 13 and 14 due to the amplitude of the edge 7.

In addition, the lead wires 13 and 14 is configured so as to traverse the edge 7 along the minor-axis direction where the width is narrow and flexural deformation is difficult to occur, in comparison with the major-axis direction. Further, even if the weight of the lead wires 13 and 14 is applied to the diaphragm 5 and the edge 7, the balance of the weight balance plus compliance of the vibration system is not lost, it becomes possible to suppress the occurrence of rolling on the diaphragm 5 and the edge 7, and high-quality reproduction with little distortion becomes possible.

It should be noted that positions for leading out the lead wires 13 and 14 on the outer periphery of the voice coil 8 are not limited to those on the major axis 11 shown in FIG. 3.

For example, a first modification of the embodiment is shown in FIG. 4. As shown in FIG. 4, the positions for leading out the lead wires 13 and 14 may be set on a minor axis 12 of the voice coil 8 connected to the outer periphery of the diaphragm 5. Then, the wiring of the lead wires 13 and 14 may be configured such that the lead wires 13 and 14 traverse over the edge 7 from these leading-out positions along the minor-axis direction.

Furthermore, the outer peripheral shapes of the diaphragm 5 and the edge 7 in a plan view may be formed in elliptical shapes, as in a second modification shown in FIG. 5.

In addition, although in the foregoing embodiment, an example of the structure has been illustrated in which the voice coil is disposed in the recess portion which is open to a front surface side of the speaker, the invention is not limited to the foregoing embodiment. For example, it is possible to employ a structure in which the voice coil is fitted to a rear surface side of a dome type diaphragm, and it goes without saying that various modifications are possible within a scope that does not depart from the gist of the invention.

As described above in detail, the oval speaker apparatus 10 of the embodiment includes the diaphragm 5 whose outer peripheral shape in a plan view is oval or elliptical; the oval or elliptical voice coil 8 for driving the diaphragm 5; the edge 7 which is joined to the outer periphery of the diaphragm 5; and the frame 4 to which the outer peripheral edge of the edge 7 is fixed. Further, the lead wires 13 and 14 which are led out from the voice coil 8 are wired so as to traverse the surface of the edge along the minor-axis direction of the diaphragm, and are provided with slack. Therefore, it is possible to prevent the disconnection of lead wires, and prevent the occurrence of distortion in the reproduced sound due to the rolling phenomenon.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An oval speaker apparatus comprising:

a diaphragm whose outer peripheral shape in a plan view is one of oval and elliptical;

a voice coil for driving the diaphragm, having one of an oval shape and an elliptical shape;

an edge which is joined to an outer periphery of the diaphragm; and a frame to which an outer peripheral edge of the edge is fixed, wherein a lead wire which is led out from the voice coil is wired so as to traverse a surface of the edge along a minor-axis direction of the diaphragm, and is provided with slack.

2. A dome type diaphragm having one of an oval shape and an elliptical shape, comprising:

a voice coil;

a lead wire led out from the voice coil, wherein the lead wire is wired so as to traverse a surface of an edge along a minor-axis direction, and is provided with slack.

* * * * *